United States Patent [19]

Barker

[11] Patent Number: 4,718,519

[45] Date of Patent: Jan. 12, 1988

[54] HIGH LIFT SCISSOR JACK

[76] Inventor: Sidney L. Barker, 4301 Hudson La., Tampa, Fla. 33624

[21] Appl. No.: 788,778

[22] Filed: Oct. 21, 1985

[51] Int. Cl.[4] ..... B66B 11/04

[52] U.S. Cl. ..... 187/18; 254/122; 403/53; 403/65

[58] Field of Search ..... 187/18, 8.71, 8.72; 254/122; 403/53, 64, 65, 205, 403

[56] References Cited

U.S. PATENT DOCUMENTS

| | | | |
|---|---|---|---|
| 32,265 | 5/1861 | Morse | 254/122 |
| 80,445 | 7/1868 | Brand | 187/18 |
| 292,995 | 2/1884 | Davis | 187/18 |
| 732,418 | 6/1903 | King | 254/122 |
| 797,077 | 8/1905 | Shaw | 187/18 |
| 859,596 | 7/1907 | Camp | 187/18 X |
| 862,639 | 8/1907 | Jefferis | 254/122 |
| 1,080,375 | 12/1913 | Senderling | 254/122 |
| 1,498,813 | 6/1924 | Sankela et al. | 187/18 |
| 1,511,679 | 6/1922 | Schwarz | 254/107 X |
| 2,625,443 | 1/1953 | Sensenbaugh | 187/18 X |
| 2,725,578 | 12/1955 | Keller | 254/122 |
| 3,672,104 | 6/1972 | Luckey | 187/18 UX |
| 3,712,488 | 1/1973 | Steves | 254/122 X |
| 3,795,289 | 3/1974 | Laforest | 187/18 |
| 4,477,201 | 10/1984 | Yoshiyuji | 403/205 X |

FOREIGN PATENT DOCUMENTS 745858 7/1980 U.S.S.R. .

*Primary Examiner*—Robert J. Spar
*Assistant Examiner*—Jay I. Alexander
*Attorney, Agent, or Firm*—Dominik, Stein, Saccocio & Reese

[57] ABSTRACT

A high lift scissors jack has three sets of scissor members. Each set is joined to the adjacent sets at the corners using connectors which maintain the base and the platform parallel as the structure extends and retracts. The connectors have angularly spaced pivots and the pivots have shoulders which provide lateral support to the ends of the lever arms. The scissor sets are joined to a support base and a platform by similar transition assemblies. The transition assemblies each include a pivoted strut for each set of scissor members. The strut has its base pivotally mounted on the support base or platform and its opposite vertex connected to the end of the scissor set. Extension and retraction are performed by rotating the support base struts about their base pivots.

12 Claims, 7 Drawing Figures

HIGH LIFT SCISSOR JACK

BACKGROUND OF THE INVENTION

1. Field of the Invention

This invention relates generally to a scissor type mechanism, and more particularly to a scissor type mechanism having improved stability.

2. Description of Background Art

A widely used lifting jack system consists of two or more scissor systems spaced apart and generally parallel to each other. This type of system is limber in the direction perpendicular to the plane of the main axes of the scissor systems, thereby limiting the useful jacking height.

Other scissor type mechanisms, while appearing to have designs which will impart stability, do not have the rugged construction needed for high lift and repetitive operations in the field. In addition, the use of sliding or rolling arrangements between the base and scissor members introduces a lack of rigidity which is not desirable in scissor type mechanisms.

Therefore, it is an object of this invention to provide an apparatus which overcomes the aforementioned inadequacies of the prior art and provides an improvement which is a significant contribution to the advancement of the art of producing a scissor type mechanism.

It is, therefore, an object of this invention to provide a scissor type mechanism which is rigid and able notwithstanding the application of eccentrically applied gravity loads as well as incidental lateral loads.

It is also an object of this invention to provide a scissor type mechanism which will maintain the support base and the platform support in parallel relationship at all times.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purpose of summarizing the invention, the invention comprises a scissor type mechanism.

A scissor type mechanism has three or more sets of scissor members with the ends of each lever arm of each set pivotably connected to the end of a lever arm in an adjacent set. The connectors used assure that all sets of scissor members will remain in parallel relationship both vertically and horizontally as the scissor mechanism is extended and retracted. The support base and platform support are also pivotably connected to the scissor mechanism through a pivoting arrangement which prevents any loss of stability. In a preferred embodiment, three sets of scissor members are arranged in an equilateral triangle configuration providing a high degree of resistance to bending.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures and manufacturing methods for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
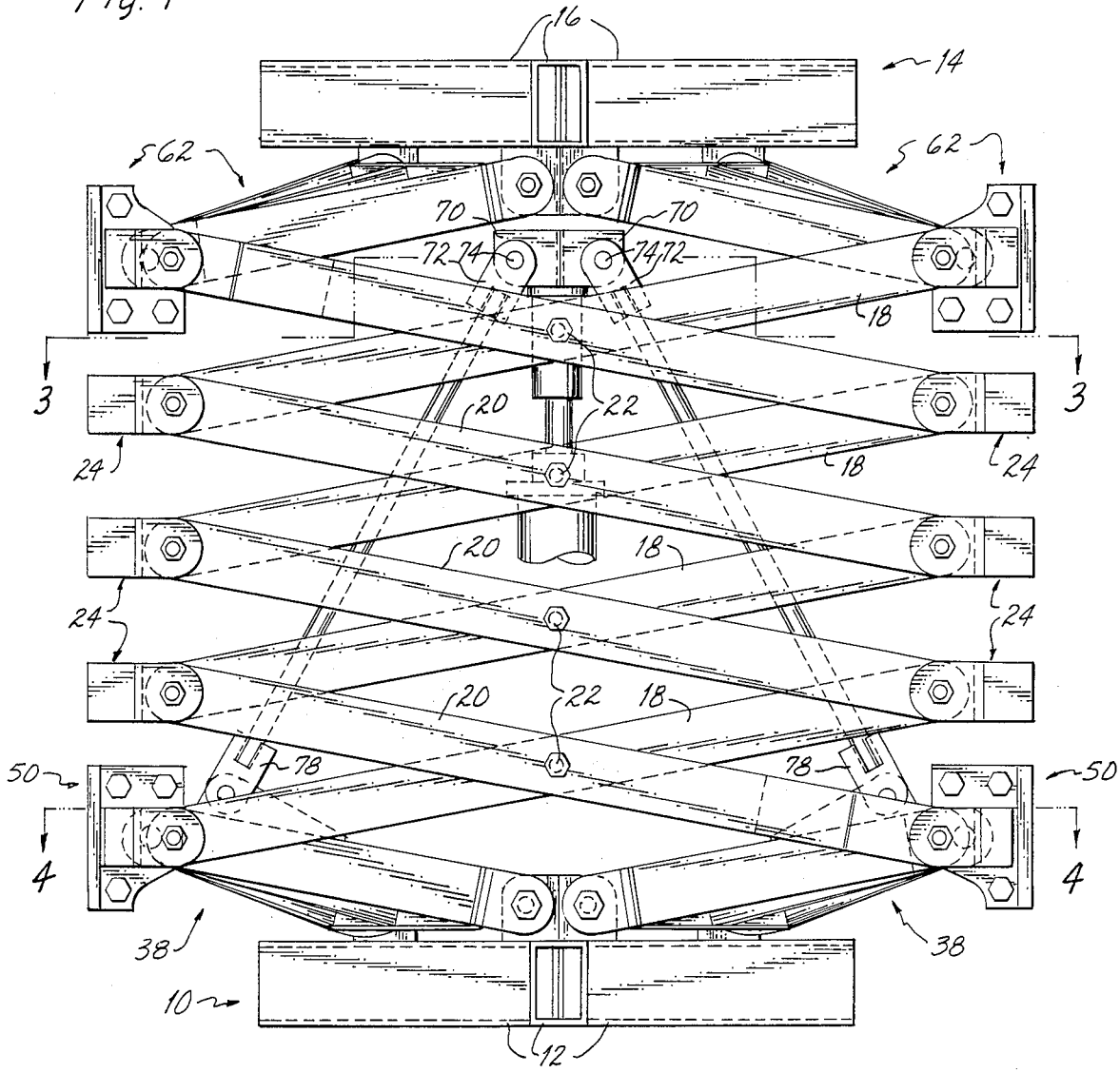
FIG. 1 is an elevation of a freestanding scissor jack in retracted position.
Figure 2:
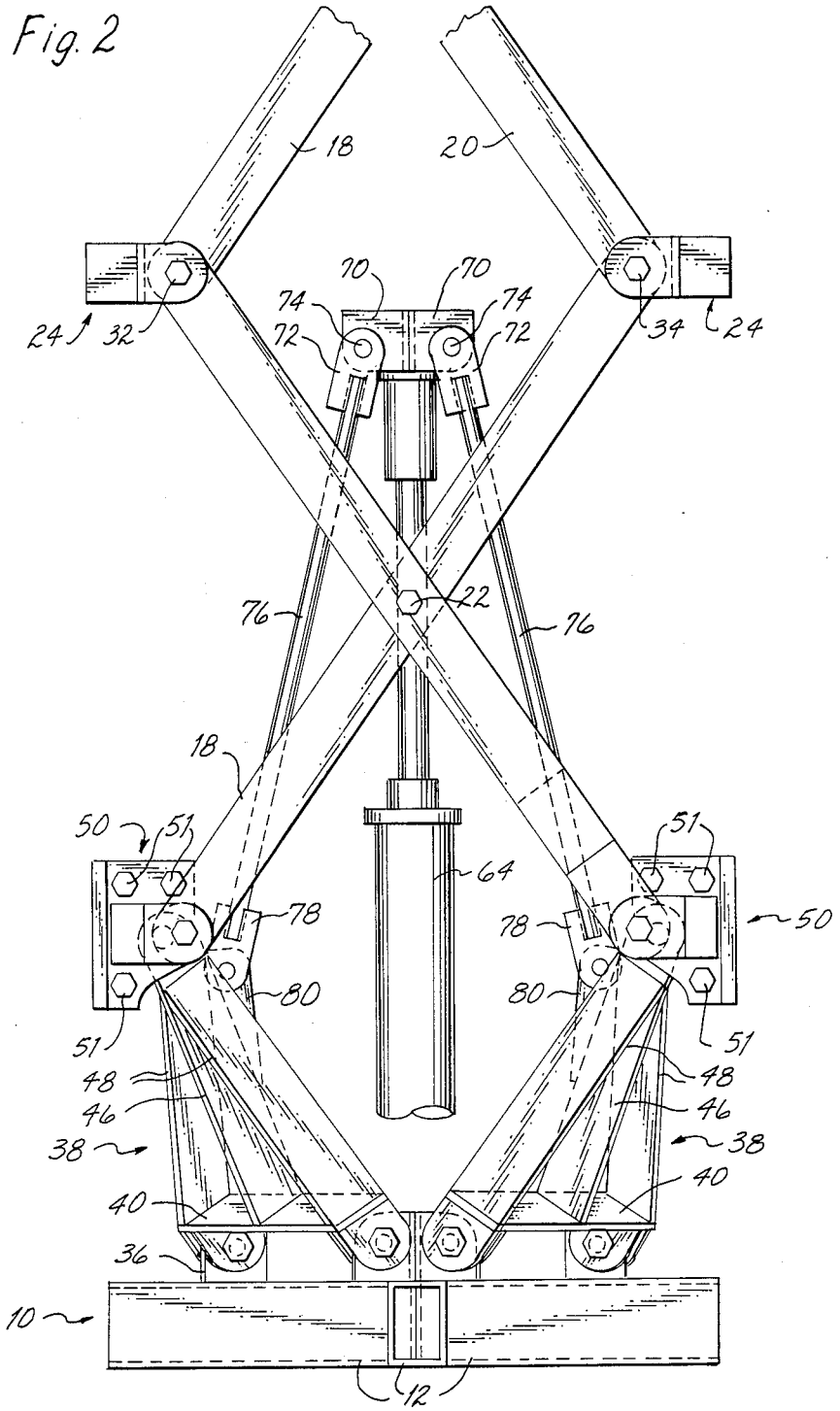
FIG. 2 is a partial elevation of the lower part of an extended freestanding scissor jack.
Figure 3:
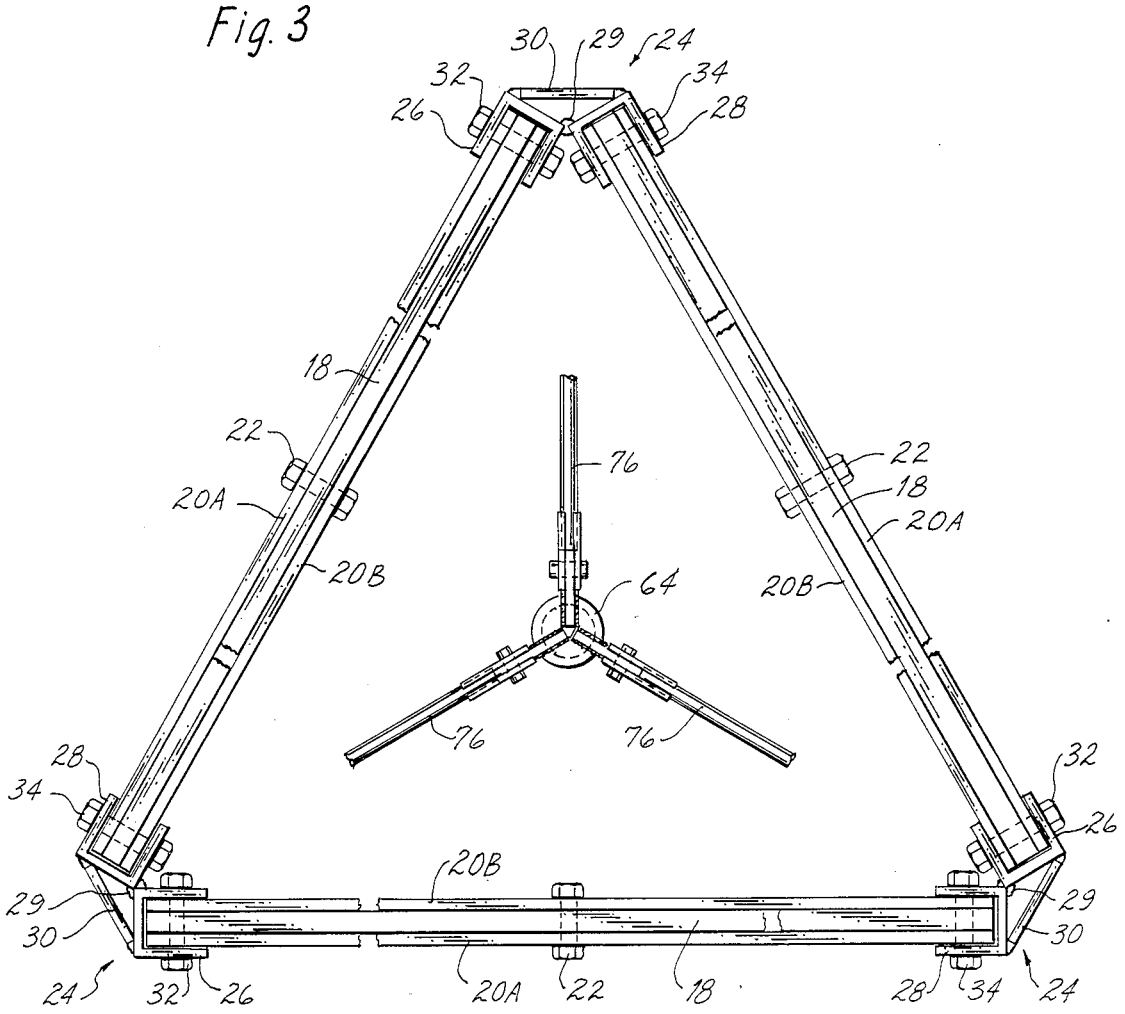
FIG. 3 is a plan view taken along the line 3—3 of FIG. 1.

FIGS. 1, 2 and 3, support base 10 is formed of a plurality of legs 12 radiating from a common center. Platform support 14 is similarly formed with radiating legs 16. Between support base 10 and platform support 14 are a plurality of sets of scissor members. As most clearly shown in FIG. 3, in this embodiment, there are three sets of scissor members; however, four or more sets may also be employed with only minor changes in the details of the overall design. Each set of scissor members has a plurality of pairs of lever arms such as lever arms 18 and 20. The number of pairs of lever arms to be used in the sets is optional. Lever arms 18 and 20 are pivotally connected by pin 22. As will be noted in FIG. 3, lever arm 20 is formed of two bars 20A and 20B, while lever arm 18 is located between the two bars of lever 20. This preferred arrangement of each pair of lever arms causes the gravity center of the scissor members to lay in the same plane, thus affording a concentric transfer of load at the connecting pin 22.

Each end of each lever arm is pivotally connected in a scissor connector, such as scissor connector 24. Scissor connector 24 has two U-shaped pivot supports 26 and 28. Pivot supports 26 and 28 are in a fixed angular relationship. As shown in FIG. 3, the adjacent corners of pivot supports 26 and 28 are secured to each other at shoulder 29, and bar 30 joins the other corners of pivot supports 26 and 28, so that the angular relationship is rigidly maintained. Because the embodiment shown has three sets of scissor members, the angle is 60 degrees. If four or more sets of scissor members were used, the angle would be 90 or more degrees. The U-shaped pivot supports 26 and 28 not only serve to support pins 32 and 34 respectively, but they also serve to laterally restrain the ends of the lever arms pivoted therein. Thus, wear (which might otherwise be experienced on a washer or the head of a bolt or rivet) is received instead by the sturdy pivot supports.

Each pivot support has a single bar lever 18 and a double bar lever 20 pinned to it, so that all scissor connectors are identical. As the scissor assembly is extended or retracted, the scissor connectors will not rotate but, instead, will maintain a constant attitude as will be seen by comparing FIGS. 1 and 2. This connection arrangement provides a positive and inherent resistance to rotation of the scissor connectors, and maintains a parallel relationship between support base 10 and platform support 14. The function of the scissor connectors is to transfer loads between the three sets of scissor members as necessary to develop a multidirectional lateral stiffness which is essential in a high lift, free-standing jack.

Figure 4:
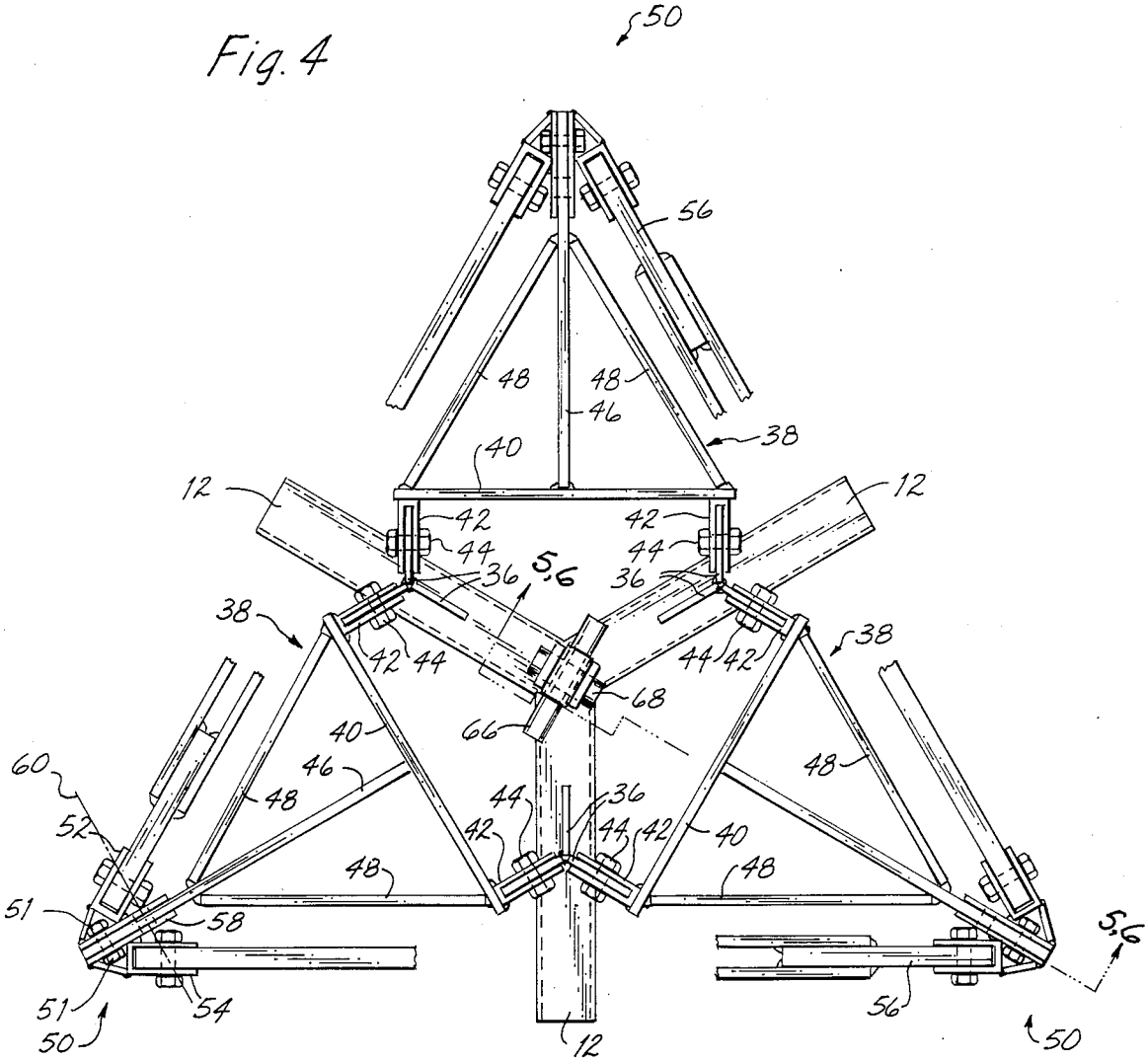
FIG. 4 is a plan view taken substantially along the line 4—4 of FIG. 1.

Referring next to FIGS. 1, 2 and 4, the transition assembly which connects the scissor sets to the base will be described. Each leg 12 of base 10 has secured to it a three legged gusset member 36. One leg of gusset members 36 on adjacent legs 12 of base 10 serves as a pivot member for pivoted strut 38. Each pivoted strut 38 has a base plate 40 with a pair of U-shaped brackets 42 secured to it at locations which will position them about the gusset leg on which they are pivoted. Pins 44 serve as the pivots for brackets 42. As pointed out with respect to connectors 24, the U-shaped brackets will cause wear due to pivoting of struts 38 to be experienced by the sturdy strut brackets rather than a washer or bolt or rivet head.

Pivoted struts 38 have secured to base plate 40 a center bar 46 which is reinforced by braces 48 secured also to the ends of base plate 40. Each strut 38 is designed to be rigid and has a secure pivoting connection to base 10 oomprising two pinned connections spaced for connection to two adjacent base members 12. Center bar 46 is pivotally connected at its other end to transition connector 50.

Transition connector 50, composed of two half sections, has three angularly spaced, U-shaped, pivot supports. Outer pivot supports 52 and 54 pivotally support the lower end of one lever arm from the adjacent sets of scissor arms. Where the lever arm is a two-piece lever arm 20, it is reduced to a single piece 56 which is of the same width at lever arm 18. In this way, outer pivot supports 52 and 54 can be fabricated to uniform dimensions. In addition to outer pivot supports 52 and 54, center pivot support 58 is provided for the pivot connection of center bar 46. The center pivot support 58 is entrained between the two half sections of the transition connector 50 by means of bolts 51. The centerline 60 of center pivot support 58 passes through the center of the pivoted connections of pivot supports 52 and 54 thereby providing for a concentric transfer of loads between the lower scissor arms and the pivoted struts 38. As with the scissor connectors 24 already described, transition connector 50 is fabricated to rigidly maintain the angular spacing of the three pivot supports. Also, the design incorporates the U-shaped brackets (which provide lateral support for the member) pivoted within the bracket and a sturdy wear surface.

Referring again to FIG. 1, a transition assembly 62 is provided to transfer loads between the scissor sets and the platform support 14. Transition assembly 62 is of the same design as the transition assembly between the scissor sets and the support base as far as the latter has been described.

Figure 5:
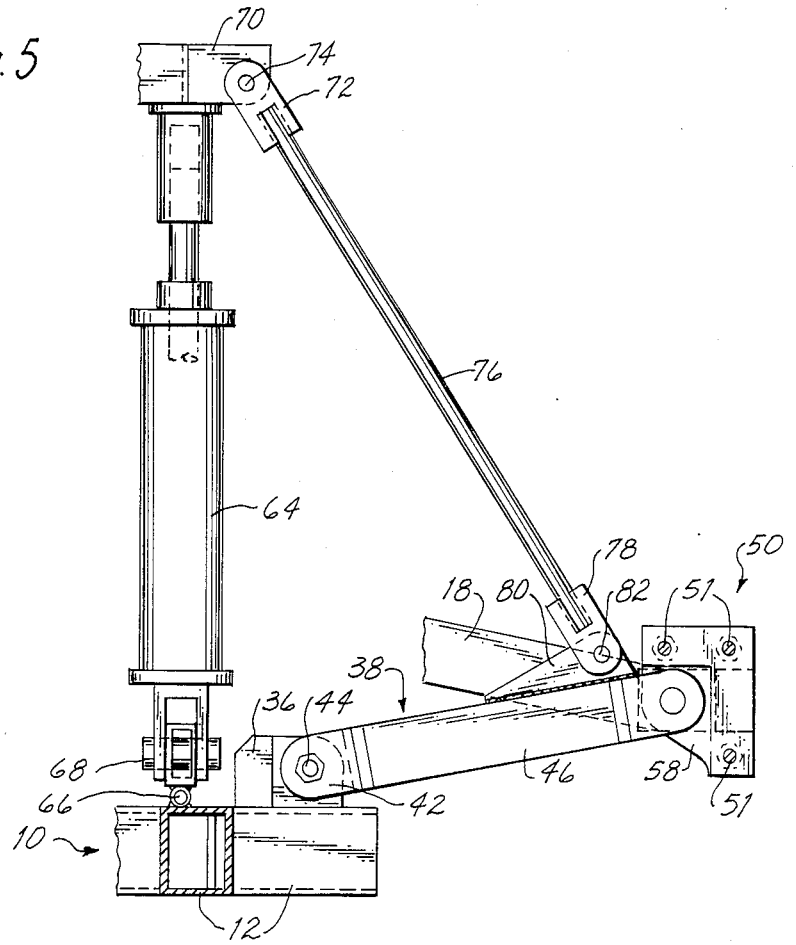
FIG. 5 is a partial elevation taken along the line 5—5 of FIG. 4 for a retracted jack position.
Figure 6:
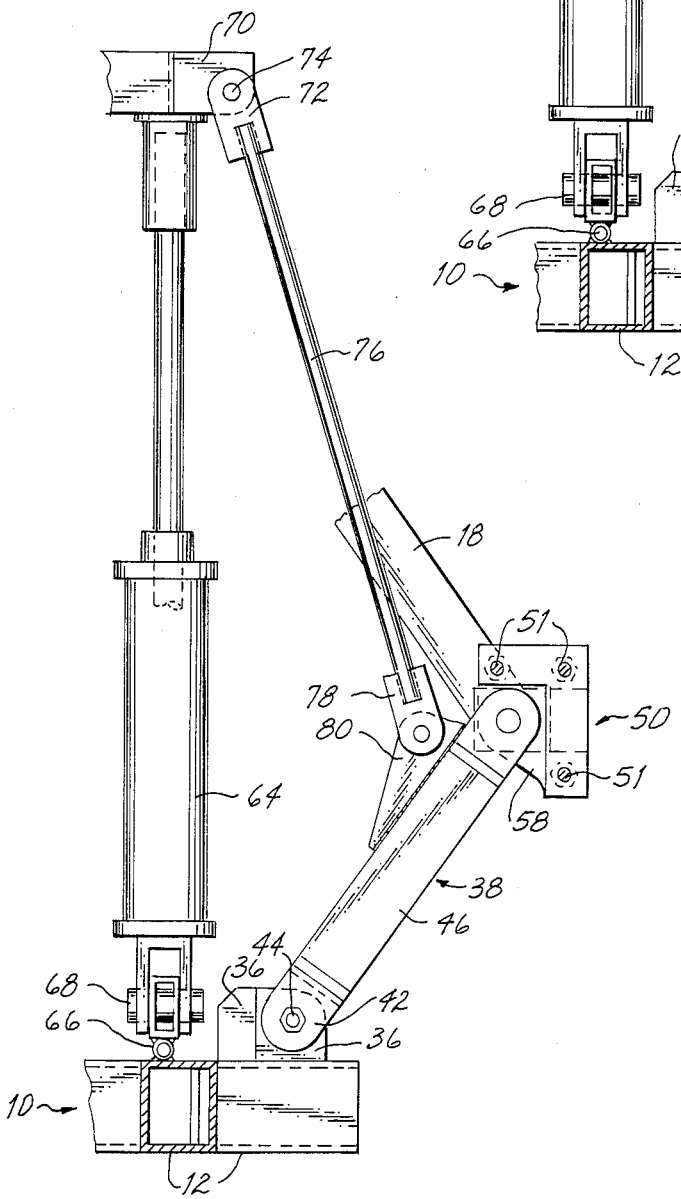
FIG. 6 is a partial elevation taken along the line 5—5 of FIG. 4 for an extended jack position.

There remains to be described some means for extending and retracting the sets of scissor members which will, of course, elevate and lower platform support 14. It will be understood that various arrangements for performing these functions are well known in the art and might be substituted for the preferred arrangement now to be described. Referring to FIGS. 1–6, hydraulic cylinder 64 is mounted on base 10. Bearing hinge pin 66 permits pivoting of cylinder 64 in one direction and cylinder pin 68, at ninety degrees to bearing hinge pin 66, permits pivoting of cylinder 64 in the other direction. Thus, hydraulic cylinder 64 can self-align. At the top of hydraulic cylinder 64 are mounted three gusset plates 70 (FIG. 5). Each gusset plate 70 has pivotally secured to it a rod connector 72 by pin 74. Lift rod 76 is secured at its top in rod connector 72, and is secured at its bottom in rod connector 78. Rod connector 78 is pivotally secured to gusset plate 80 by pin 82. Gusset plate 80 is secured to the top of center bar 46 of pivoted strut 38. As is evident, hydraulic pressure applied to cylinder 64 will cause lift rods 76 to raise and, thereby, cause pivoted struts 38 to pivot inwardly as shown in FIG. 6. Because of the pivotable connections throughout the apparatus, the scissor mechanisms will extend as shown in FIG. 2. Reducing the hydraulic pressure, or applying it in the opposite direction, will cause the scissor mechanisms to retract.

Figure 7:
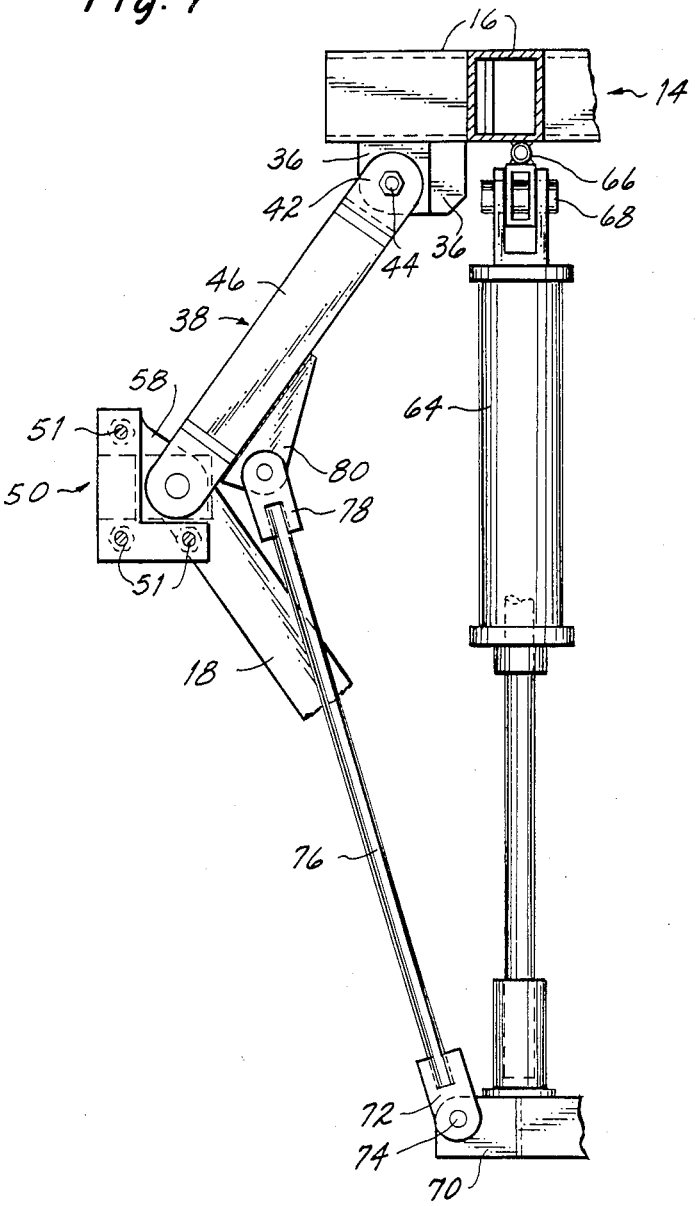
FIG. 7 is partial elevational view illustrating the hydraulic cylinder mounted to the underside of the platform support.

The embodiment illustrated and described employs three sets of scissor mechanisms which results in a structure having a high degree of resistance to bending away from its longitudinal axis. This structure, while eminently useful as a high-lift scissors jack, may also be used as the working arm of a robot, or as a boom. It should also be noted that the structure, when used as a high-lift scissors jack, can be inverted so that hydraulic cylinder 64 is positioned beneath platform support 14, as shown in FIG. 7.

A similar structure can also be built using four or more sets of scissor mechanisms.

Although a preferred embodiment of the invention has been illustrated and described, it will be evident to one skilled in the art that modifications can be made without departing from the spirit of the invention and the scope of the appended claims.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit of the invention.

Now that the invention has been described, what is claimed is:

1. A high lift scissors jack comprising:

a support base;

a platform support;

a plurality of sets of scissor members;

each of said sets of scissor members having a plurality of pairs of lever arms;

each of said pairs of lever arms pivotally connected at their centers;

a plurality of connectors;

each of said connectors having two pivots spaced from each other at a fixed angle;

each of said connector pivots supported on adjacent sides by a shoulder;

said lever arms of each of said pairs having respective ends connected to one of said connector pivots, and the other of said connector pivots being connected to an end of a lever arm in an adjacent set of scissor members;

a first transition assembly connecting said support base to the bottom of each of said sets of scissor members, said first transition assembly comprising a pivoted strut for each intersection of adjacent sets of scissor members pivotally mounted to said support base with two spaced pivots, and a transition connector for each intersection of adjacent sets of scissor members having three pivots spaced from each other at fixed angles, each of said pivots supported on each side by a shoulder, each of the two outer pivots of said three pivots serving as the connector pivot for the lowest lever of one of the adjacent sets of scissor members, and the center pivot of said three pivots connected to said strut for the intersection of adjacent sets of scissor members;

a second transition assembly connecting said platform to the top of each of said sets of scissor members; and means for extending and retracting said sets of scissor members.

2. A high lift scissors jack comprising:

a support base;

a platform support;

a plurality of sets of scissor members;

each of said sets of scissor members having a plurality of pairs of lever arms;

each of said pairs of lever arms pivotally connected at their centers;

a plurality of connectors;

each of said connectors having two pivots spaced from each other at a fixed angle;

each of said connector pivots supported on adjacent sides by a shoulder;

said lever arms of each of said pairs having respective ends connected to one of said connector pivots, and the other of said connector pivots being connected to an end of a lever arm in an adjacent set of scissor members;

a first transition assembly connecting said support base to the bottom of each of said sets of scissor members;

a second transition assembly connecting said platform to the top of each of said sets of scissor members, said second transition assembly comprising:

a pivoted strut for each intersection of adjacent sets of scissor members pivotally mounted to said platform support with two spaced pivots, and a transition connector for each intersection of adjacent sets of scissors members having three pivots spaced from each other at fixed angles, each of said pivots supported on each side by a shoulder, each of the two outer pivots of said three pivots serving as the connector pivot for the highest lever of one of the adjacent sets of scissor members, and the center pivot of said three pivots connected to said strut for the intersection of adjacent sets of scissor members; and means for extending and retracting said sets of scissor members.

3. A high lift scissors jack comprising:

a support base;

a platform support;

a plurality of sets of scissor members;

each of said sets of scissor members having a plurality of pairs of lever arms;

each of said pairs of lever arms pivotally connected at their centers;

a plurality of connectors;

each of said connectors having two pivots spaced from each other at a fixed angle;

each of said connector pivots supported on adjacent sides by a shoulder;

said lever arms of each of said pairs having respective ends connected to one of said connector pivots, and the other of said connector pivots being connected to an end of a lever arm in an adjacent set of scissor members;

a first transition assembly connecting said support base to the bottom of each of said sets of scissor members, said first transition assembly comprising a pivoted strut for each intersection of adjacent sets of scissor members pivotally mounted to said support base with two spaced pivots, and a transition connector for each intersection of adjacent sets of scissor members having three pivots spaced from each other at fixed angles, each of said pivots supported on each side by a shoulder, each of the two outer pivots of said three pivots serving as the connector pivot for the lowest lever of one of the adjacent sets of scissor members, and the center pivot of said three pivots connected to said strut for the intersection of adjacent sets of scissor members;

a second transition assembly connecting said platform to the top of each of said sets of scissor members; and means for extending and retracting said sets of scissor members, said means for extending and retracting said sets of scissor members comprising a hydraulic cylinder mounted on said support base, a lift rod connected between the extendable top of said hydraulic cylinder and each of said pivoted struts, whereby as said hydraulic cylinder is extended said lift rods will raise said struts about their pivots.

4. An extendable and retractable structure comprising:

a support base;

three base struts having triangular configurations with the base of each of said struts pivotally mounted on said support base at equal angular intervals;

each of said base struts having a center bar extending from the center of its base;

a transition connector for each base strut having a center pivot connecting said center bar and two outer pivots;

extreme lever arms on one end of each of a set of scissor members being connected to one of said outer pivots of said transition connectors for each platform strut; and means for pivoting said base struts about their base pivots.

5. A high lift scissors jack comprising:

a three legged support base;

a three legged platform support;

three sets of scissor members;

each of said sets of scissor members having a plurality of pairs of lever arms;

each of said pairs of lever arms pivotally connected at their centers;

a plurality of connectors;

each of said connectors having two pivots spaced from each other at a fixed angle;

each of said connector pivots supported on adjacent sides by a shoulder;

said lever arms of each of said pairs having respective ends connected to one of said connector pivots, and the other of said connector pivots being connected to an end of a lever arm in an adjacent set of scissor members;

a first transition assembly connecting said support base to the bottom of each of said sets of scissor members, said first transition assembly comprising:

a pivoted strut for each intersection of adjacent sets of scissor members pivotally mounted to said support base with two spaced pivots, and a transition connector for each intersection of adjacent sets of scissor members having three pivots spaced from each other at fixed angles, each of said pivots supported on each side by a shoulder, each of the two outer pivots of said three pivots serving as the connector pivot for the lowest lever of one of the adjacent sets of scissor members, and the center pivot of said three pivots connected to said strut for the intersection of adjacent sets of scissor members;

a second transition assembly connecting said platform to the top of each of said sets of scissor members; and means for extending and retracting said sets of scissor members.

6. A high lift scissors jack comprising:

a three legged support base;

a three legged platform support;

three sets of scissor members;

each of said sets of scissor members having a plurality of pairs of lever arms;

each of said pairs of lever arms pivotally connected at their centers;

a plurality of connectors;

each of said connectors having two pivots spaced from each other at a fixed angle;

each of said connector pivots supported on adjacent sides by a shoulder;

said lever arms of each of said pairs having respective ends connected to one of said connector pivots, and the other of said connector pivots being connected to an end of a lever arm in an adjacent set of scissor members;

a first transition assembly connecting said support base to the bottom of each of said sets of scissor members;

a second transition assembly connecting said platform to the top of each of said sets of scissor members, said second transition assembly comprising:

a pivoted strut for each intersection of adjacent sets of scissor members pivotally mounted to said platform support with two spaced pivots, and a transition connector for each intersection of adjacent sets of scissor members having three pivots spaced from each other at fixed angles, each of said pivots supported on each side by a shoulder, each of the two outer pivots of said three pivots serving as the connector pivot for the highest lever of one of the adjacent sets of scissor members, and the center pivot of said three pivots connected to said strut for the intersection of adjacent sets of scissor members; and means for extending and retracting said sets of scissor members.

7. A high lift scissors jack comprising:

a three legged support base;

a three legged platform support;

three sets of scissor members;

each of said sets of scissor members having a plurality of pairs of lever arms;

each of said pairs of lever arms pivotally connected at their centers;

a plurality of connectors;

each of said connectors having two pivots spaced from each other at a fixed angle;

each of said connector pivots supported on adjacent sides by a shoulder;

said lever arms of each of said pairs having respective ends connected to one of said connector pivots, and the other of said connector pivots being connected to an end of a lever arm in an adjacent set of scissor members;

a first transition assembly connecting said support base to the bottom of each of said sets of scissor members, said first transition assembly comprising:

a pivoted strut for each intersection of adjacent sets of scissor members pivotally mounted to said platform support with two spaced pivots, and a transition connector for each intersection of adjacent sets of scissor members having three pivots spaced from each other at fixed angles, each of said pivots supported on each side by a shoulder, each of the two outer pivots of said three pivots serving as the connector pivot for the lowest lever of one of the adjacent sets of scissor members, and the center pivot of said three pivots connected to said strut for the intersection of adjacent sets of scissor members;

a second transition assembly connecting said platform to the top of each of said sets of scissor members; and means for extending and retracting said sets of scissor members, said means for extending and retracting said sets of scissor members comprising a hydraulic cylinder mounted on said support base, a lift rod connected between the extendable top of said hydraulic cylinder and each of said pivoted struts, whereby as said hydraulic cylinder is extended said lift rods will raise said struts about their pivots.

8. Transition assembly for interconnecting three or more scissor sets of a three-dimensional scissor-type mechanism to a support, comprising in combination:

a pivoted strut for connection to each intersection of adjacent scissor sets;

means for pivotally connecting each of said pivoted struts to the support, said means comprising two spaced and in-line pivots;

a transition connector connected to each said pivot strut at a pivot point, each said transition connector having three pivots spaced from each other at fixed angles, the center pivot thereof being connected to said pivoted strut and the other pivots being connected to the lowermost level of adjacent scissor sets.

9. The transition assembly in accordance with claim 8, further including means for extending and retracting the three-dimensional scissor-type mechanism, comprising in combination:

a hydraulic cylinder mounted on said support base, said hydraulic cylinder having an extendable top; and a lift rod connected between said extendable top of said hydraulic cylinder and each of said pivoted struts whereby, as said hydraulic cylinder is extended, said lift rods will raise said pivoted struts about their respective base pivots and whereby, as said hydraulic cylinder is retracted, said lift rods will lower said pivoted struts about their respective base pivots.

10. A transition assembly for interconnecting three or more scissor sets of a three-dimensional scissor-type mechanism to a platform, comprising in combination:

a pivoted strut for connection to each intersection of adjacent scissor sets;

means for pivotably connecting each of said pivoted struts to the platform, said means comprising two spaced and in-line pivots;

a transition connector connected to each said pivot strut at a pivot point, each said transition connector having three pivots spaced from each other at fixed angles, the center pivot thereof being connected to said pivoted strut and the other pivots being connected to the uppermost level of adjacent scissor sets.

11. The transition assembly in accordance with claim 10, further including means for extending and retracting the three-dimensional scissor-type mechanism, comprising in combination:

a hydraulic cylinder mounted on said platform, said hydraulic cylinder having an extendable bottom; and a lift rod connected between said extendable bottom of said hydraulic cylinder and each of said pivoted struts whereby, as said hydraulic cylinder is extended, said lift rods will lower said pivoted struts about their respective platform pivots and whereby, as said hydraulic cylinder is retracted, said lift rods will raise said pivoted struts about their respective platform pivots.

12. A scissor connector for a three-dimensional scissor-type mechanism comprising in combination:

an assembly of two U-shaped pivot supports with adjacent corners directly connected and with remote corners connected by a bar such that a base of said pivot supports and said bar define a triangle; and each of said two pivot supports astride and pivotally connected to an intersection of levers of adjacent scissor sets.

* * * * *

UNITED STATES PATENT AND TRADEMARK OFFICE

CERTIFICATE OF CORRECTION

PATENT NO. : 4,718,519

DATED : January 12, 1988

INVENTOR(S) : Sidney L. Barker

It is certified that error appears in the above-identified patent and that said Letters Patent is hereby corrected as shown below:

In column 8, at line 47 please delete "platform support" and insert therefor --support base--.

Signed and Sealed this

Twenty-third Day of August, 1988

*Attest:*

DONALD J. QUIGG

*Attesting Officer*

*Commissioner of Patents and Trademarks*